US005371577A

United States Patent [19]

Fujimura et al.

[11] Patent Number: 5,371,577

[45] Date of Patent: Dec. 6, 1994

[54] OZONE FILTER USED IN ELECTROPHOTOGRAPHIC APPARATUS INCLUDING CATALYST OF CUO, $MNO_2$, AND A WATER-SOLUBLE POLYMER

[75] Inventors: Naoto Fujimura, Yokohama; Koji Yamazaki, Nagahama; Kiyoshi Sakai, Chofu; Teigo Sakakibara; Noriko Hirayama, both of Tokyo, all of Japan

[73] Assignee: Canon Kabushiki Kaisha, Tokyo, Japan

[21] Appl. No.: 8,827

[22] Filed: Jan. 25, 1993

Related U.S. Application Data

[63] Continuation of Ser. No. 522,726, May 14, 1990, abandoned.

[30] Foreign Application Priority Data

May 16, 1989 [JP] Japan ..... 1-123870

[51] Int. Cl.[5] ..... G03G 21/00

[52] U.S. Cl. ..... 355/215; 502/263; 358/300; 355/18

[58] Field of Search ..... 355/18, 215; 55/387; 422/180; 358/300; 502/263

[56] References Cited

U.S. PATENT DOCUMENTS

| | | | |
|---|---|---|---|
| 4,143,118 | 3/1979 | Laing | 422/178 X |
| 4,200,552 | 4/1980 | Noguchi et al. | 502/263 |
| 4,280,926 | 7/1981 | Abe et al. | 422/180 X |
| 4,388,274 | 6/1983 | Rourke et al. | 355/18 X |
| 4,680,040 | 7/1987 | Gooray | 55/387 |
| 4,749,671 | 6/1988 | Saito et al. | 502/263 X |
| 4,876,606 | 10/1989 | Banno et al. | 358/476 X |

FOREIGN PATENT DOCUMENTS

| | | |
|---|---|---|
| 0038224 | 10/1981 | European Pat. Off. . |
| 3026969 | 2/1981 | Germany . |
| 60-244326 | 12/1985 | Japan . |
| 1-068774 | 3/1989 | Japan . |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An electrophotographic apapratus of the type in which a photosensitive member is charged by atmospheric discharge, is equipped with an air filter including a substrate and a catalyst layer formed on the substrate including at least three components of CuO, $MnO_2$ and a water-soluble polymer. The catalyst layer shows a reactivity with NOx and the water-soluble polymer traps the resultant $HNO_3$ while retaining a high ozone removing efficiency, whereby the apparatus can show excellent electrophotographic performances even after successive use while preventing deterioration due to ozone, NOx and $HNO_3$ produced by the atmospheric discharge.

9 Claims, 3 Drawing Sheets

OZONE FILTER USED IN ELECTROPHOTOGRAPHIC APPARATUS INCLUDING CATALYST OF CUO, $MNO_2$, AND A WATER-SOLUBLE POLYMER

This application is a continuation of application Ser. No. 07/522,726 filed May 14, 1990, now abandoned.

FIELD OF THE INVENTION AND RELATED ART

The Present invention relates to an electrophotographic apparatus, AND particularly relates to an electrophotographic apparatus chiefly comprising a charging means, an exposure means and a developing means and which is equipped with an air filter when atmospheric discharge generating a so-called corona product, such as $O_3$, NOx or $HNO_3$, is used as the charging means in the electrophotographic apparatus.

At present, as the electrophotographic apparatus, a copying machine, laser beam printer (LBP), microreader printer, etc., are manufactured. Such an electrophotographic apparatus includes means for charging, exposure, developing, transfer, cleaning, whole exposure, etc., respectively disposed around an electrophotosensitive member.

As the electrophotosensitive member, a photosensitive member comprising an organic photoconductor (OPC) which is inexpensive, pollution-free and high sensitive or a photosensitive member comprising amorphous silicon (a-Si) which is pollution-free, high-durable and high-stable are being adopted as the mainstream.

In such an electrophotographic apparatus, as a charging method, non-contact methods using a corona discharge, etc. and contact methods using a conductive brush, conductive roller, etc. are used. However, because all these methods are those utilizing the atmospheric discharge method, the corona products of ozone, etc. are generated. Particularly, when the corona charging method using the corona discharge is used, a large amount of ozone is generated to adhere to the electrophotosensitive member, whereby deterioration of the electrophotosensitive member and degradation of electrophotographic characteristics are induced. Accordingly, methods for lessening the influence of ozone on the electrophotosensitive member by emitting the ozone out of the apparatus as quickly as possible with an exhaust fan and an air filter using activated carbon or by disposing an ozone-decomposing catalyst intermediately on an exhaust passage for removing ozone, have been taken.

However, in recent years, progress of the electrophotography is remarkable to provide high-quality images, pictorial full-colored images and computer-graphic images, so that requirements for uniformity of images are markedly severe. Further, by the provision of a high-speed and high-durability electrophotographic apparatus, it has become possible to take a lot of copies at a time. In such conditions, image defects in the form of a belt arise in a direction perpendicular to the rotating direction of the electrophotosensitive member, i.e., in the generatrix direction of the electrophotosensitive member. The image defects are observed as image unevenness represented by a difference in reflection density of 0.05 or more. On investigation of the cause of the image defects, we have found that a part of the electrophotosensitive member (i.e., the hatched portion of the electrophotosensitive member in FIG. 1) stopping at a position immediately below a primary charger and in the exhaust passage has received some damage when the electrophotographic apparatus is not operated. In such a case, the electrophotographic apparatus using the OPC photosensitive member causes, e.g., a partial decrease in chargeability (i.e., white dropout of an image in normal development and a black streak of an image in reversal development) and the electrophotographic apparatus using the a-Si photosensitive member causes an image blur (i.e., a decrease in resolution).

On our study, we have found that the above-mentioned drawbacks are principally caused by NOx, particularly $HNO_3$ resulting from the atmospheric discharge, such as the corona discharge. This is based on a confirmation by means of infrared analysis that the part around the photosensitive member under the primary charger deteriorated because of the action of $HNO_3$. In general, ozone density under the primary charger is one to several tens ppm and NOx density (converted into $NO_2$ density) under the primary charger is 0.01–0.1 ppm. On the other hand, though NOx and $HNO_3$ are not removed by means of a conventional ozone-removing filter, it has been considered that there would be no problem if they are emitted out of an apparatus together with ozone by means of an exhaust fan because of their low densities, so that no particular consideration has been paid on disposition thereof.

However, though ozone entirely becomes extinct if once it is removed, NOx is supposed to be transformed into a stable substance, such as $NO_2$ or $HNO_3$ to remain for a long time because a large amount of $NO_2$ or $HNO_3$ is physically adsorbed to a member having a large surface area such as the ozone-removing filter. Further, it is reasonably considered that once adsorbed $NO_2$ or $HNO_3$ is desorbed and flown backward in the apparatus when the apparatus is stopped. It is possible that NOx or $HNO_3$ emitted out of the apparatus fills a room to recirculate in the apparatus. Further, it is possible that a part of the air containing NOx or $HNO_3$ once passed through the filter is again taken in the apparatus.

Generally, the air filter is formed by coating a substrate with activated carbon or various ozone-decomposing catalysts kneaded together with a binder such as clay cr glass. Such a conventional ozone-removing filter had no effect of removing NOx and $HNO_3$.

SUMMARY OF THE INVENTION

An object of the invention is to provide an electrophotographic apparatus capable of preventing a part of a photosensitive member beneath a primary charger from causing a local decrease in chargeability or image blurring to obtain a high-quality image.

According to the present invention, there is provided an electrophotographic apparatus of the type in which a photosensitive member is charged by atmospheric discharge, which apparatus is equipped with an air filter comprising a catalyst layer including at least three components of CuO, $MnO_2$ and a water-soluble polymer.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
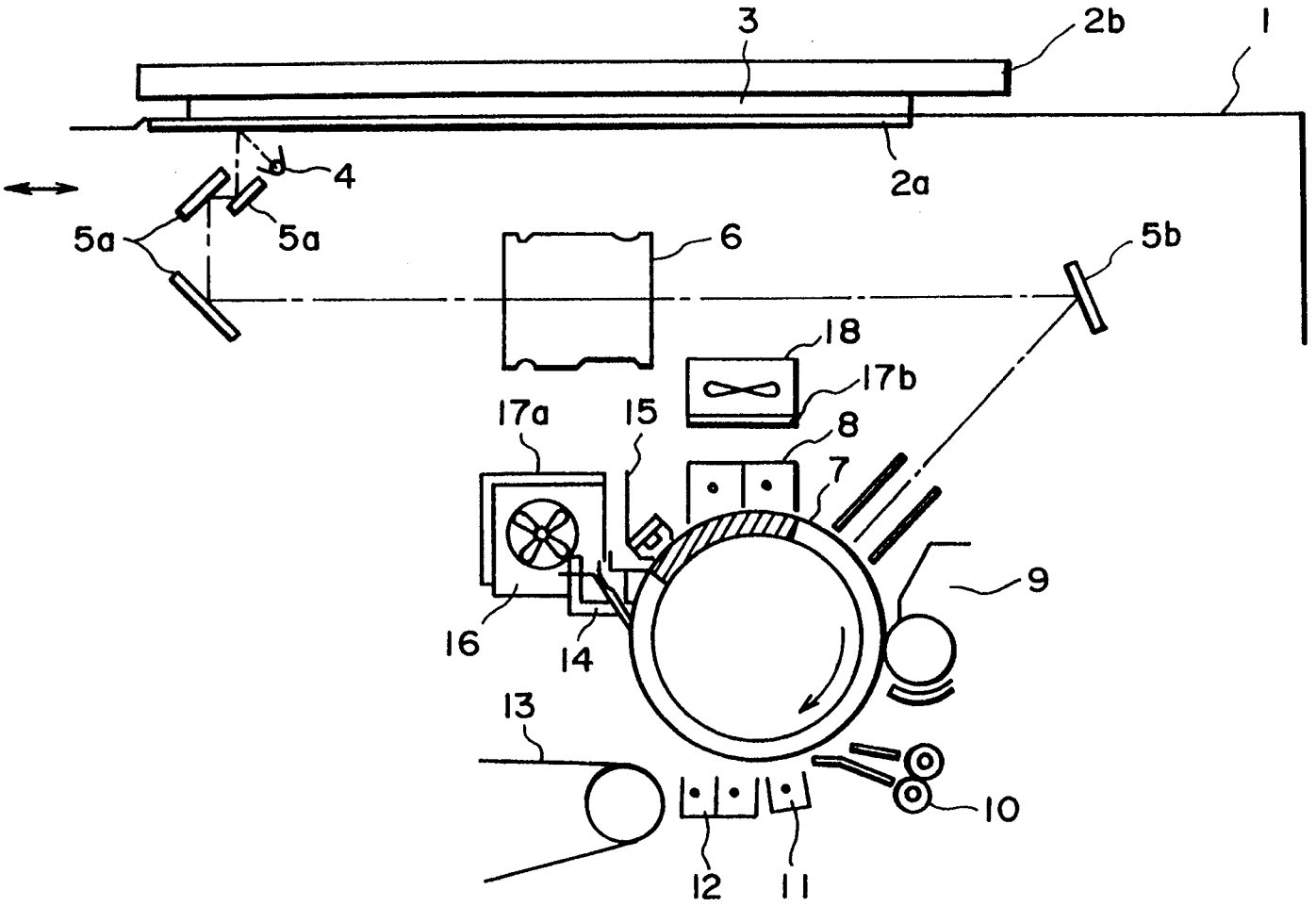
FIG. 1 is a schematic structural view of an electrophotographic apparatus according to the present invention.

We have studied various combinations of binders together with various catalyst. As a result, we have found that an air filter comprising CuO, $MnO_2$ and a water-soluble polymer in combination provides an elongated life of a catalyst having ozone-decomposing ability and has an excellent ability of removing NOx and $HNO_3$. We have also found that a trace amount of additive, such as Fe, A1, Ca, Na or their oxides may be mixed with the catalyst to further improve the removing ability for NOx and $HNO_3$. When the electrophotographic apparatus of the invention equipped with the air filter was used actually for an experiment, the air filter did not cause a lowering in ozone-removing rate at all and showed a high removing ability for NOx and $HNO_3$ (As described later, the removing ability for $HNO_3$ has been evaluated by a durability test using an actual electrophotographic apparatus because there is no means for directly measuring $HNO_3$ density.).

The air filter according to the present invention provides decreased densities of NOx and $HNO_3$ in exhaust gas and prevents NOx and $HNO_3$ from desorbing flowing backward or recirculating in the electrophotographic apparatus by chemically adsorbing NOx and $HNO_3$ once adsorbed on the surface of the air filter. Further, the air filter also has an ozone-removing ability more than that of a conventional air filter.

CuO and $MnO_2$ are basic oxides and they are supposed to be essentially able to react with $HNO_3$, thus having an ability of removing $HNO_3$, respectively. However, the removing ability for $HNO_3$ is supposed to be almost lost when they are mixed with a conventional binder, such as clay or glass. On the other hand, a water-soluble polymer absorbs moisture in ordinary environment and has an ability of trapping $HNO_3$ having hydrophilicity. Further, we suppose that NOx, $HNO_3$, $O_3$, etc. arrive at the surface of the catalyst relatively easily and are fixed thereon because the water-soluble polymer generally has a large gas permeability. However, the mechanism of mixing of CuO and $MnO_2$ has been hardly clarified.

Fe, A1, Ca, Na and their oxides have reactivity with $HNO_3$ and are supposed to contribute to the trapping ability for $HNO_3$ in view of the fact that they promote the effect when they are added in a small amount.

The air filter used in the invention has a basic structure comprising a substrate coated with a catalyst layes-comprising at least three components of CuO, $MnO_2$ and a water-soluble polymer. A weight ratio of CuO/$MnO_2$ may be in the range of 1/0.1 to 1/10, preferably 1/0.5 to ⅛. The water-soluble polymer used in the catalyst layer may include a natural polymer such as starch, casein or gelatin; and a synthetic polymer, such as cellulose, water-soluble polyamide, polyacrylic acid ammonium salt or watersoluble polymer having quaternary ammonium salt. A weight ratio of the water-soluble polymer/(CuO and MnO2) in the catalyst layer may be in the range of 0.01/1 to 0.5/1, preferably 0.05/1 to 0.3/1. When the above weight ratio is below 0.01/1, the catalyst layer is liable to be peeled off the substrate due to an external force. such as wind pressure or vibration. Further, when the above weight ratio is above 0.5/1, the removing ability for ozone etc. is liable to decrease because the catalyst components are covered with a thick film of the water-soluble polymer.

For example, the air filter used in the invention may be provided in the following manner. A prescribed amount of CuO/$MnO_2$ mixture is added to a solution of a prescribed amount of the water-soluble polymer in an appropriate amount of water under stirring. A substrate is coated with the solution, e.g., by dipping and then dried to provide an air filter comprising a catalyst layer. The thickness of the dried catalyst layer may be 0.1–500 microns, preferably 1–300 microns.

The substrates used in the air filter may include those of paper, cloth, ceramics such a alumina, silica and chromium oxide, etc.; those having a coating of at least one metal, such as aluminum iron, aluminum alloy and iron alloy on the above substrates; and those of a metal plate or metal foil comprising at least one metal, such as aluminum, iron, aluminum alloy and iron alloy. The air filter including such a substrate comprising at ].east one metal such as aluminum, iron, aluminum alloy and iron alloy, may preferably be used because it provides a remarkably improved ability of removing NOx, particularly $HNO_3$.

The catalyst components may further include the above-mentioned trace additive, such as Fe, A1, Ca, Na or their oxides. The trace additive content in the catalyst may preferably be 20 ppm—5% by weight, particularly be 50 ppm—2% by weight, of the total amount of CuO and $MnO_2$.

Figure 2:
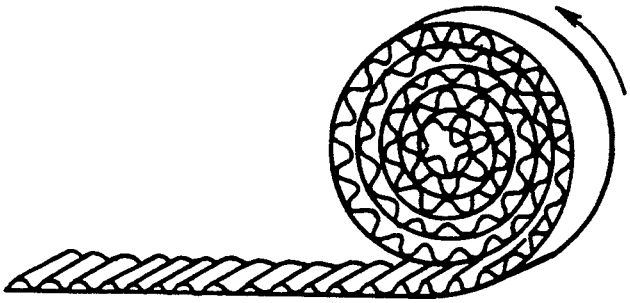
FIG. 2 is a schematic view of an air filter having a roll structure of corrugated board.
Figure 3:
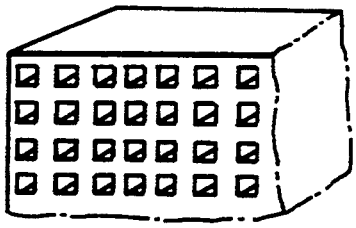
FIG. 3 is a schematic view of an air filter formed by molding.
Figure 4:
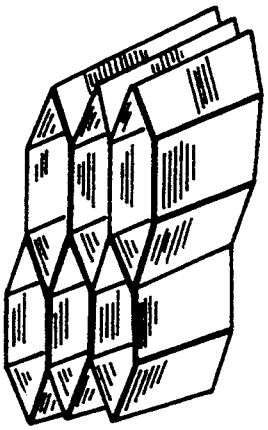
FIG. 4 is a schematic view of an air filter having a honeycomb structure formed from a metal foil.

The air filter used in the invention may preferably be in such a form that provides a large efficiency for removing $O_3$, NOx and $HNO_3$ and a decreased pressure loss; one such form is a network structure. Such a network structure may include, e.g., a roll structure of corrugate board as shown in FIG. 2; one having many perforations formed by molding as shown in FIG. 3; and a honeycomb structure as shown in FIG. 4. Among them, the honeycomb structure as shown in FIG. 4 formed by using a metal foil comprising at least one metal of, e.g., aluminum, iron, aluminum alloy and iron alloy, as the substrate, may particularly be preferred. Because the thickness of the metal foil may arbitrarily be selected in the range of about 10–200 microns and a cell gap (i.e., wall thickness) in the substrate is thinner than that in a conventional substrate using paper or ceramics, the removing efficiency of $O_3$, NOx and $HNO_3$ is remarkably improved. Particularly, in a large-sized air filter, one comprising ceramics etc., with a small strength inevitably requires a large wall thickness to result in a decreased aperture rate and an increase in pressure loss. On the other hand, the metal foil is much better in this respect. Further, the substrate formed of a metal foil has advantages of low production costs etc. compared with one formed by molding. A substrate having a honeycomb structure can be formed by using the above-mentioned metal foil. The surface of the metal foil can be roughened in order to enhance the adhesive strength and enlarge the surface area, so that the removing rate of NOx and $HNO_3$ is improved.

FIG. 1 is a schematic structural view of an electrophotographic apparatus of the invention using the air filter. Referring to FIG. 1, the electrophotographic apparatus includes a housing 1, on which an original cover 2b and an original stand 2a comprising a glass plate are disposed. An original 3 placed on the original stand 2a is irradiated with light from a lamp 4. Then, the reflected light passes through mirrors 5a, a lens 6 and a mirror 5b to reach a photosensitive drum 7 used as an image-carrying member, which comprises an amorphous silicon photosensitive layer formed on a cylindrical substrate by film formation. The above lamp 4, mirrors 5a and lens 6 are capable of moving in the direction of the upper left arrow shown in FIG. 1 by a drive means (not shown) in the housing 1. The above photosensitive drum 7 is rotated in the direction of the arrow shown inside of the photosensitive drum in FIG. 1 and uniformly charged by means of a primary charger 8 utilizing corona discharge. On the photosensitive drum, image exposure with the reflected light from the original 3 is effected to form an electrostatic latent image. The electrostatic latent image is developed by a developing unit 9 to form a toner image. The toner image is carried together with a recording material such as a plastic film (not shown) supplied from a register roller 10, to reach a position opposite to a transfer charger 11 utilizing corona discharge, and then the toner image is transferred to the recording material. Then, the resultant recording material with the toner image is separated from the photosensitive drum 7 by using a separation charger 12 utilizing corona discharge to be conveyed to a fixing device (not shown). Residual toner particles on the photosensitive drum 7 are removed by means of a cleaner 14, and residual charge on the photosensitive drum 7 is erased by emitting erasing light 15 to prepare for the next cycle. During the above-mentioned image forming process, air is exhausted to the outside of the apparatus by means of an exhaust fan 16. In this instance, an air filter 17a is disposed for treating the air. On the other hand, air is sent into the apparatus through an air filter 17b by means of a blowing fan 18.

Figure 5:
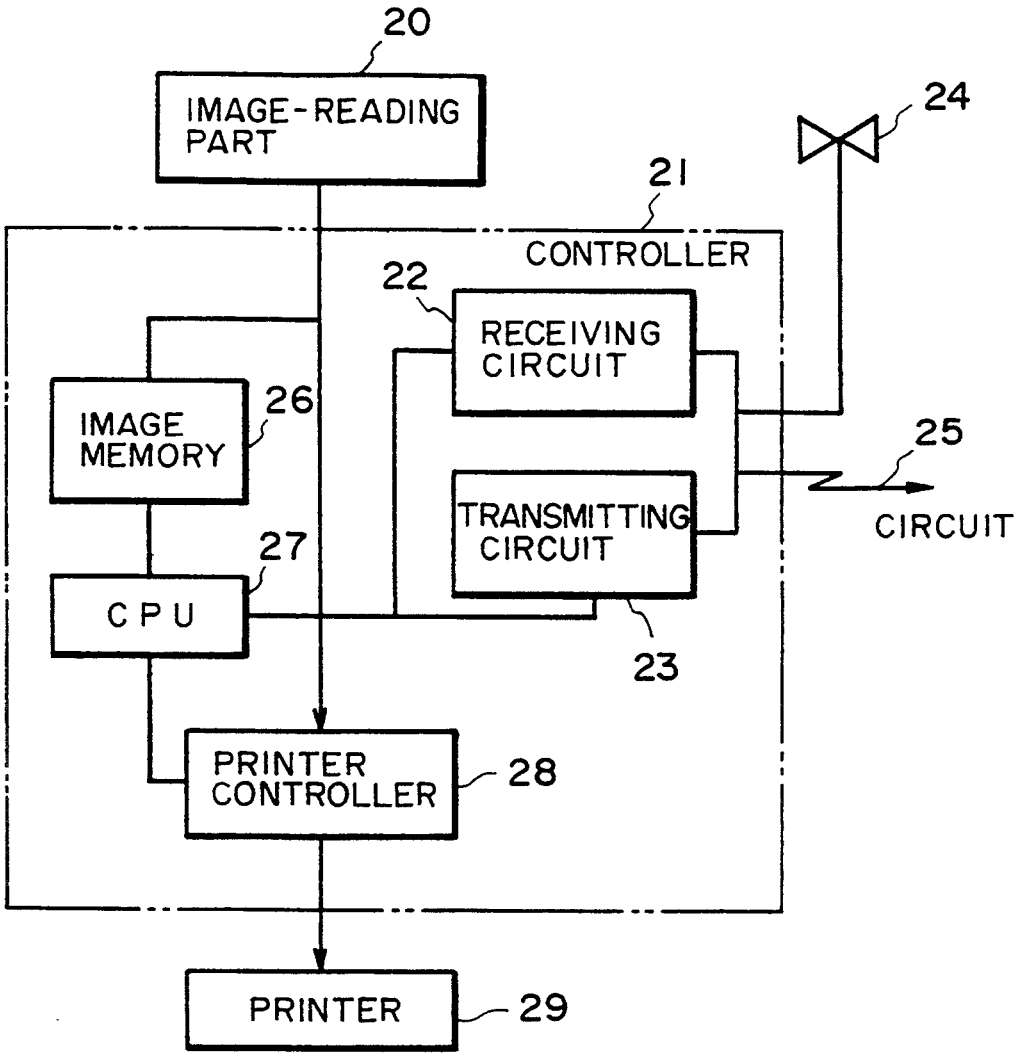
FIG. 5 is a block diagram of a facsimile machine using an electrophotographic apparatus of the invention as a printer.

In a case where the electrophotographic apparatus according to the present invention is used as a printer of a facsimile machine, light-image exposure is used as exposure for printing received data. FIG. 5 shows a block diagram of an embodiment for explaining this case. Referring to FIG. 5, a controller 21 controls a image-reading part 20 and a printer 29. The whole controller 21 is controlled by means of a CPU (central processing unit) 27. Read data from the image-reading part is transmitted to a partner station through a transmitting circuit 23, and on the other hand, the received data from the partner station is sent to the printer 29 through a receiving circuit 22. An image memory memorizes prescribed image data. A printer controller 28 controls the printer 29 and a reference numeral 24 denotes a telephone.

The image received through a circuit 25 (the image data sent through the circuit from a connected remote terminal) is demodulated by means of the receiving circuit and successively stored in an image memory 26 after a restoring-signal processing of the image data. When image for at least one page is stored in the image memory 26, image recording of the page is effected. The CPU 27 reads out the image data for one page from the image memory 26 and sends the image data for one page subjected to the restoring-signal processing to the printer controller 28. The printer controller 28 receives the image data for one page from the CPU 27 and controls the printer 29 in order to effect image-data recording. Further, the CPU 27 is caused to receive image for a subsequent page during the recording by the printer 29. As described above, the receiving and recording of the image are performed.

Hereinbelow, the present invention will be explained more specifically with reference to examples.

EXAMPLES 1 AND 2

A substrate having a honeycomb structure as shown in FIG. 4 was prepared by using a 50 micron-thick iron foil. The substrate had material properties including: a cell density of 140 cells/inch$^2$, an aperture rate of 75%, a surface area of 20 cm$^2$/cm$^3$, sizes of 100 mm$\times$100 mm and a thickness of 5 mm. Then, a $CuO/MnO_2$ mixture in a weight rate of 1/1 was added to a starch aqueous solution and dispersed therein at a rate of (CuO and MnO2)/starch=5/1 by weight. The dispersion was applied on the substrate by dipping and dried to form a 100 micron-thick catalyst layer. The air filter thus prepared is referred to as a filter 1.

Separately, an iron substrate having a structure including many perforations as shown in FIG. 3 was prepared by molding. The iron substrate had material 0roperties including: a wall thickness of 0.3 mm, an aperture rate of 64%, a cell density of 210 cells/inch$^2$, a pitch of 1.7 mm, a surface area of 18 cm$^2$/cm$^3$, size of 100 mm$\times$100 mm and a thickness of 5 mm. The catalyst layer was formed in the same manner as in the case of the filter 1. The air filter thus prepared is referred to as a filter 2.

Further, an air filter was prepared in the same manner as in the case of the filter 2 except that the iron substrate was replaced with an alumina substrate to Frovide a filter 3.

Still further, an air filter was prepared in the same manner as in the case of the filter 3 except that the catalyst layer was replaced with one formed in such a manner that activated carbon having a particle size of 100 microns and a binder consisting of clay and glass (activated carbon/binder=10/1 by weight) were kneaded together with an appropriate amount of water, applied on the substrate at a rate of 200 g/m$^2$ by dipping, and dried to prepare a coating layer for removing ozone, to provide a filter 4.

An exhaust port (the reference numeral 17a in FIG. 1) of a color laser copying machine (CLC-1, manufactured by Canon K.K.) was equipped with each of the above-prepared air filters. Then, the measurement of the densities of $O_3$ and NOx (converted into $NO_2$ density) in the exhaust air and examination of image characteristics after a durability test were performed. The above test is referred to as Example 1.

Separately, a ventilation port (the reference numeral 17b in FIG. 1) of the blowing fan for blowing the primary changer of the above color laser copying machine was equipped with the above-prepared air filters, respectively. Then, the measurement and the examination were performed in the same manner as in Example 1 to provide Example 2.

In Examples 1 and 2, the exhaust density was measured after one hour from the start of a continuous copying test by means of a measuring apparatus (1003-AH, manufactured by Dylec Corp.) for $O_3$ density and a measuring apparatus (ECL-77A, manufactured by Yanagimoto Seisakusho K.K.) for NOx density. The exhaust air was passed through the filter at a velocity of 0.8 m/sec. Further, the durability test was performed by using the above-mentioned copying machine as follows. The copying machine was first used for making 10,000 sheets by using a mode giving one A4-sized full-color copy every 30 seconds, thereafter left standing in the room for three days, and then used again for forming images, the states of which were observed for examination.

The results of Examples 1 and 2 are shown in Table 1 below.

TABLE 1

| Ex. No. | Filter | $O_3$ density (ppm) | NOx density (ppm) | Image defects after durability test* (After standing for 3 days) |
|---|---|---|---|---|
| 1 | 1 | 0.13 | 0.011 | None/Utterly None |
| | 2 | 0.18 | 0.014 | " |
| | 3 | 0.18 | 0.018 | Slightly observed/None |
| | 4 | 0.19 | 0.030 | Remarkably observed/ Problem |
| 2 | 1 | 0.10 | 0.005 | None/Utterly None |
| | 2 | 0.13 | 0.009 | " |
| | 3 | 0.13 | 0.013 | " |
| | 4 | 0.14 | 0.030 | Remarkably observed/ Problem |

*Change in image density at a portion under a primary charger/ Problem for practical use.

As is apparent from Example 1 in Table 1, in the electrophotographic apparatus of the invention using the air filters 1, 2 and 3, NOx density was remarkably decreased compared with one using the conventional filter 4 (particularly, filter 1/filter 4 ratio of about ⅓) and there was no problem for practical use. On the other hand, the filter 4 was not acceptable for practical use. Further, $O_3$ density by the filter 1 particularly showed a lower value by about 30% then by the filter 4 This is presumably because the filter 1 of the invention had a honeycomb structure of a metal foil which provided advantages of a small pressure loss and a large surface area.

The results in Example 2 are the same as in Example 1 and show that the removing rate of $O_3$ or NOx was further improved by equipping the ventilation port to the primary charger with a filter of the invention. It is supposed that $O_3$ and NOx were not completely removed out of the above copying machine by the exhaust fan, remained partially in the machine to be recirculated by the blowing fan etc., and another part was once removed out of the machine and taken in the machine again.

Further, it is supposed that the phenomenon of the image density under the primary charger becoming high was directly caused by the action of $HNO_3$. It is supposed that $HNO_3$ caused the above phenomenon because $HNO_3$, different from $O_3$ and NOx, adhered to various inside positions of the machine after the termination of copying and was desorbed little by little to move and act on a certain position of the photosensitive member for a long time. On the other hand, the air filter used in the invention has reactivity with $HNO_3$ (and further has good adsorption efficiency because of large surface area), whereby once adsorbed $HNO_3$ is hardly separated from the air filter. Though $HNO_3$ could not be quantitatively measured, it was possible to observe a marked removing effect for $HNO_3$ when the durability test was done by using an actual copying machine.

EXAMPLE 3

An air filter 5 was prepared in the same manner as in the case of the filter 1 except that a 25 micron-thick aluminum foil substrate was used. The thus prepared filter 5 was examined in the same manner as in Example 2 to show the following results.

$O_3$ density: 0.12 ppm

HNOx density: 0.007 ppm

Image: after durability test: No image change was observed at a portion beneath the primary charger, and utterly nc. problem was recognized for practical use.

EXAMPLE 4

Air filters 6–10 were prepared in the same manner as in the case of the filter I except that polymer weight ratios of starch (water-soluble polymer) to (CuO and MnO2) (catalyst) were changed to 0.01, 0.05, 0.2, 0.3 and 0.5, respectively. The thus prepared filters 6–10 and the filter 4 for comparison were each examined in the same manner as in Example 2 except that unevenness of image density (which was evaluated by a difference in Macbeth reflection density between a normal position and an abnormal position) and strength of the catalyst layer in the durability test were measured. The results are shown in Table 2 below.

TABLE 2

| Filter | Polymer weight ratio | $O_3$ density (ppm) | NOx density (ppm) | Unevenness of image density: Density difference | Unevenness of image density: Image | Strength of catalyst layer | Judgement |
|---|---|---|---|---|---|---|---|
| 6 | 0.01 | 0.09 | 0.006 | 0.05 | ∘Δ | Substantially* No problem | Δ |
| 7 | 0.05 | 0.09 | 0.005 | 0 | ∘ | No problem | ∘ |
| 8 | 0.2 | 0.10 | 0.005 | 0 | ∘ | " | ∘ |
| 9 | 0.3 | 0.12 | 0.005 | 0 | ∘ | " | ∘ |
| 10 | 0.5 | 0.15 | 0.006 | 0.05 | ∘Δ | " | Δ |
| 4 | — | 0.14 | 0.030 | 0.25 | xx | " | x |

*The catalyst layer was stable in normal use but was separated when it was touched by a hand.

As is apparent from Table 2, judging from all the factors of $O_3$ removing ability, NOx removing ability, unevenness of image density (i.e., corresponding to $HNO_3$ removing ability), and strength of the catalyst layer when the amount of the water-soluble polymer is arbitrarily changed, the weight ratio of the water-soluble polymer to the total catalyst may preferably be in the range of 0.01–0.5, particularly 0.05–0.3.

EXAMPLE 5

Air filters were prepared in the same manner as in the case of the filter 1 except that trace additives of 100 ppm of Fe, 100 ppm of Al and 200 ppm of Fe and Ca (100 ppm each) were further added to the $CuO/MnO_2$ mixture to provide air filters 11–13, respectively. The thus prepared filters were each examined in the same manner as in Example 1 to show the following results.

| | $O_3$ density (ppm) | NOx density (ppm) | Image after durability test |
|---|---|---|---|
| Filter 11: | 0.13 | 0.008 | None/Utterly None |
| Filter 12: | 0.13 | 0.007 | " |

-continued

| | $O_3$ density (ppm) | NOx density (ppm) | Image after durability test |
|---|---|---|---|
| Filter 13: | 0.12 | 0.007 | " |

From the above results, it is found that the NOx removing ability was further improved in comparison with the filter 1.

As described above, the electrophotographic apparatus according to the present invention has an excellent effect of removing NOx, particularly $HNO_3$ without decreasing $O_3$ removing efficiency, prevents deterioration of copy image quality caused by $HNO_3$, and can provide images having no defects even after successive use.

What is claimed is:

1. In an electrophotographic apparatus in which a photosensitive member is charged by atmospheric discharge; the improvement wherein the apparatus is equipped with an air filter including a substrate and a catalyst layer comprising at least three components of CuO, $MnO_2$ and a water-soluble polymer formed on the substrate, wherein a weight ratio of the water-soluble polymer to CuO and $MnO_2$ is in the range of 0.01/1 to 0.5/1 and, in the catalyst layer, the CuO and $MnO_2$ are dispersed in the water-soluble polymer.

2. An electrophotographic apparatus according to claim 1, wherein a weight ratio of the water-soluble polymer/(CuO adn $MnO_2$) is in the range of 0.05/1 to 0.3/1.

3. An electrophotographic apparatus according to claim 1, wherein the water-soluble polymer comprises at least one polymer selected from the group consisting of a water-soluble natural polymer and a water-soluble synthetic polymer.

4. An electrophotographic apparatus according to claim 1, wherein the catalyst layer is formed on the substrate comprising at least one metal selected from the group consisting of aluminum, iron, aluminum alloy and iron alloy.

5. An electrophotographic apparatus according to claim 1, wherein the catalyst layer further comprises at least one additional component selected from the group consisting of iron, aluminum, calcium, sodium and their oxides.

6. An electrophotographic apparatus according to claim 5, wherein the additional component is added in the range of 0.002% to 5% by weight to said CuO and $MnO_2$.

7. An electrophotographic apparatus according to claim 1, wherein the air filter has a network structure.

8. An electrophotographic apparatus according to claim 7, wherein1 the network structure of the air filter is a honeycomb structure.

9. A facsimile machine comprising an electrophotographic apparatus equipped with a charging means utilizing atmospheric discharge and an air filter comprising a catalyst layer including at least three components of CuO, $MnO_2$ and a water-soluble polymer, and a receiving means for receiving image data from a remote terminal, wherein a weight ratio fo the water-soluble polymer to CuO and $MnO_2$ is in the range of 0.01/1 to 0.5/1 and, in the catalyst layer, the CuO and $MnO_2$ are dispersed in the water-soluble polymer.

* * * * *